United States Patent [19]

Robbins et al.

[11] 4,234,235

[45] Nov. 18, 1980

[54] ROTARY CUTTERHEAD FOR AN EARTH BORING MACHINE

[75] Inventors: Richard J. Robbins, Seattle; Barry A. Spencer, Redmond, both of Wash.

[73] Assignee: The Robbins Company, Seattle, Wash.

[21] Appl. No.: 9,170

[22] Filed: Feb. 5, 1979

[51] Int. Cl.[3] ..... E21D 9/10

[52] U.S. Cl. ..... 299/56; 299/33; 299/90; 299/86; 299/93

[58] Field of Search ..... 299/56, 58, 31, 33, 299/90

[56] References Cited

U.S. PATENT DOCUMENTS

| | | | |
|---|---|---|---|
| 9,179 | 8/1852 | Catlin | 175/361 |
| 883,137 | 3/1908 | Karns | 299/90 |
| 1,803,875 | 5/1931 | Stoody et al. | 175/411 |
| 3,005,627 | 10/1961 | Tinlin | 299/56 |
| 3,139,148 | 6/1964 | Robbins | 299/90 |
| 3,203,737 | 8/1965 | Robbins et al. | 299/31 |
| 3,301,600 | 1/1967 | Pirrie | 299/33 |
| 3,358,782 | 12/1967 | Bechman | 175/344 |
| 3,756,332 | 9/1973 | Crane | 299/86 X |
| 3,861,748 | 1/1975 | Cass | 299/10 |
| 3,917,351 | 11/1975 | Pirrie | 299/90 |
| 3,961,825 | 6/1976 | Lovar | 299/31 |

OTHER PUBLICATIONS

Chapter 21, 1976 RETC proceedings, Grandori, 6/14/1976.

Robbins drawings D10679, D10665, sheets 1 and 2 of 2, and sheets 2 and 3 of 12.

Photographs of Robbins Model 144–151, 165–162.

*Primary Examiner*—William F. Pate, III

*Attorney, Agent, or Firm*—Graybeal & Uhlir

[57] ABSTRACT

A main frame includes an annular beam by which the cutterhead is mounted onto an earth boring machine for a rotation about an axis of rotation. A plurality of radial spoke beams extend generally vertically at the front of cutterhead and curve rearwardly to intersect with the annular beam. Each radial spoke beam is constructed from a pair of spaced apart side plate members which define spaces between them for receiving a plurality of roller cutter mounts therebetween. Roller cutters, including gauge cutters, can be installed and removed from their associated cutter mounts from the rear side of the cutterhead. A plurality of generally radially elongate cut-ground-material passageways extend through the cutterhead in the regions between the radial spoke beams. A plurality of concentric, substantially circumferentially continuous face-support-ring members are located forwardly of the cutterhead main frame but rearwardly of the peripheral cutting edges of the cutters in at least the radial region of cutterhead in which the cut-ground-material passage ways are located. During rotation of the cutterhead, face-support-ring members support fractured material against the face of the tunnel while the roller cutters cut concentric kerfs with such material.

28 Claims, 11 Drawing Figures

Fig. 2.
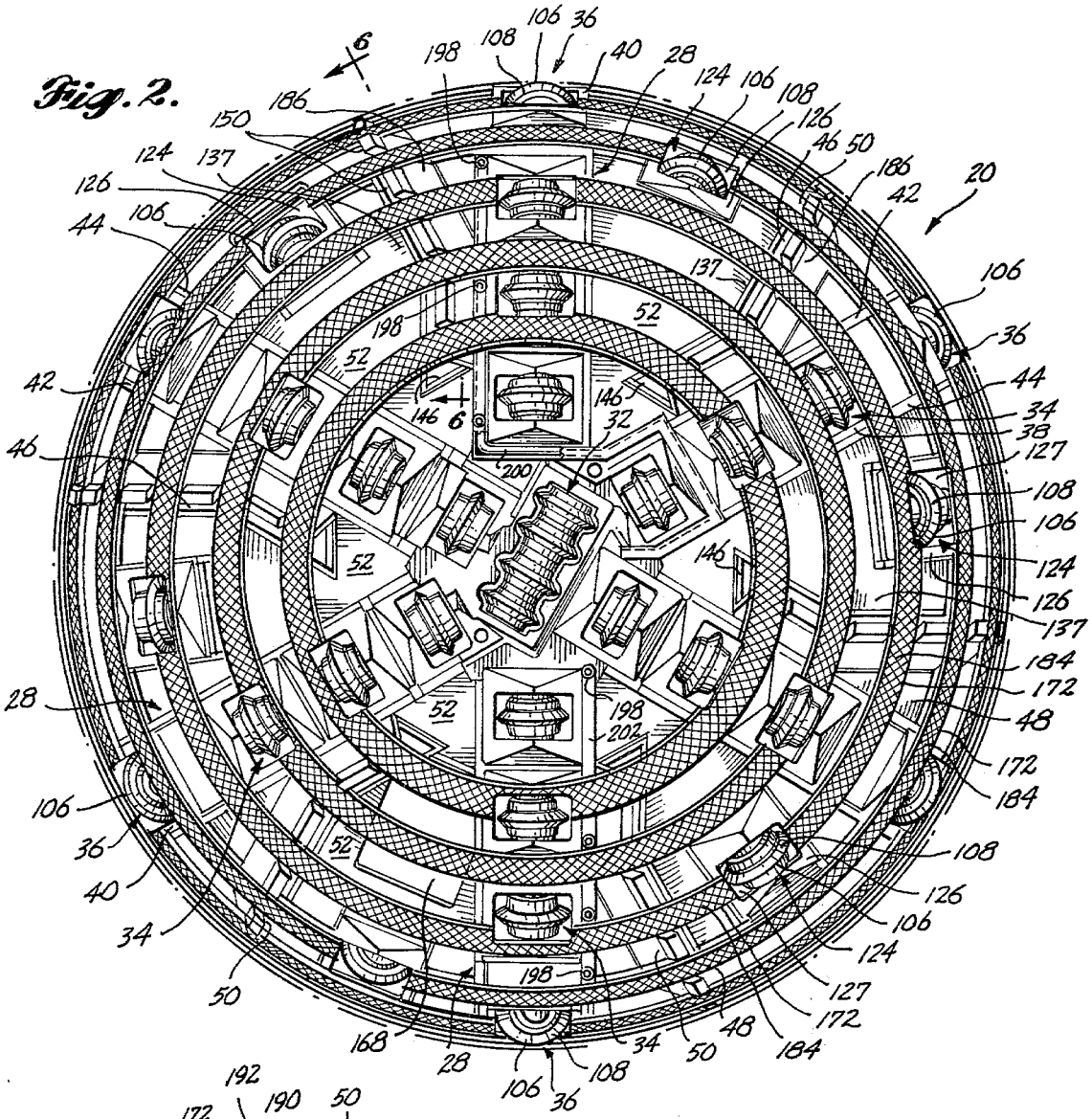
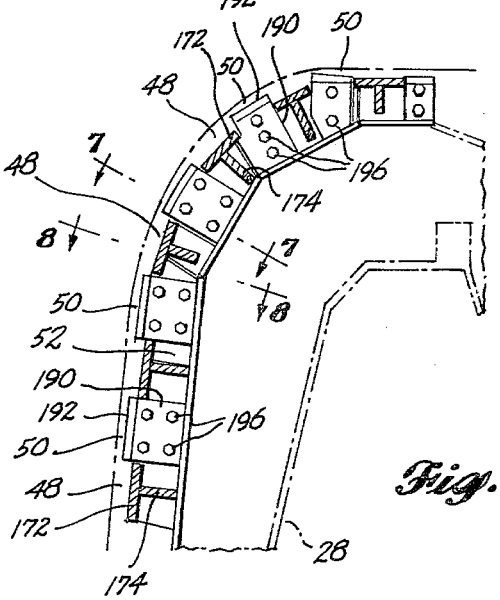
Fig. 6.
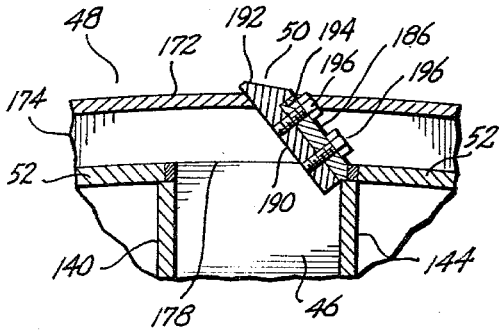
Fig. 7.

ROTARY CUTTERHEAD FOR AN EARTH BORING MACHINE

BACKGROUND OF THE INVENTION

1. Field of the Invention

The present invention relates to rock boring machines, and in particular to a new rotary cutterhead construction for use on such a machine.

2. Description of the Prior Art

Rotary cutterheads have for some time been used in conjunction with various types of earth tunneling machines. Two examples of somewhat different tunneling machines are disclosed by U.S. Pat. No. 3,861,748, granted Jan. 21, 1975, to David T. Cass and by chapter 21 of the 1976 RETC Proceedings authored by Carlo Gorandori and published on or about June 14, 1976. The tunneling machines which are disclosed by these two publications include in basic form a frame structure which is composed of a cutterhead support and rearwardly projecting beam. A cutterhead carrying forwardly directed cutters is mounted on the cutterhead support for rotation about an axis corresponding to the longitudinal center of the tunnel being bored. The cutterhead support and usually at least the forward portion of the beam are encircled by a tubular shield having a diameter moderately less than the diameter of the tunnel being bored. A rear gripper assembly, which includes a set of gripper shoes for pressing laterally outwardly to bear against the side walls of the tunnel, is supported for sliding movement along the length of the beam. If the boring machine is to be used in relatively soft ground material, a rear shield may also be provided to encircle the rearwardly portion of the beam. The rear shield is provided with openings through which the rear gripper shoes may extend and retract.

Longitudinally disposed thrust rams interconnect the cutterhead support and the rear gripper assembly for lengthwise relative movement of the rear gripper assembly along the beam. Typical types of thrust rams are disclosed by U.S. Pat. No. 3,203,737 granted Aug. 31, 1975, to Richard J. Robbins, Douglas F. Winberg and John Galgoczy, and by U.S. Pat. No. 3,861,748 granted Jan. 21, 1975, to David T. Cass.

In operation, when the rear gripper assembly is positioned forwardly on the beam, the gripper shoes are hydraulically moved outwardly to gripping contact with the side walls of the tunnel. Then, the rotary cutterhead is rotated by drive motors while the thrust rams are simultaneously extended to thereby push the cutterhead and main frame, including the beam, longitudinally ahead. When the thrust rams reach their forward limits of travel, the rear gripper shoes are withdrawn from the tunnel wall and then the thrust cylinders are retracted to thereby draw the gripper assembly forwardly along the length of the beam into a new position. Thereafter, the rear gripper shoes are again moved outwardly into contact with the tunnel wall and the above procedure is repeated.

If the tunneling machine is to operate in relatively soft ground material, a forward gripper assembly, which is mounted on the main frame forwardly of the thrust rams, may be required to maintain the cutterhead and main frame in position while the rear gripper assembly is being repositioned. Similarly to the operation of the rear gripper assembly, the shoes of the front gripper assembly are hydraulically moved outwardly into gripping contact with the side wall of the tunnel. Thereafter, the thrust cylinders are retracted to pull the gripper assembly forwardly into a new position. Then the front gripper shoes are withdrawn while the rear gripper shoes are extended outwardly into contact with the tunnel wall to begin new boring sequence.

Various types of cutterheads have been commonly used in conjunction with the earth boring machine described above. The particular type of cutterhead with which this invention is concerned is termed an "open face" cutterhead and is characterized by openings in the face of the cutterhead to permit mined material to pass directly rearwardly through the cutterhead itself so that such material can then be carried out through the rear of the tunnel being bored.

An open face type of cutterhead having a typical arrangement of cutters is disclosed in U.S. Pat. No. 3,375,332, granted Sept. 4, 1973, to Clayton H. Crane, and assigned to The Robbins Company. This particular cutterhead includes a plurality of disc cutter assemblies positioned on the cutterhead for cutting concentric kerfs in the ground material. The disc cutters include circumferential cutting edges which are flanked by sloping breaker surfaces that serve to fracture and dislodge the rock material located between the kerfs which are cut by the cutting edges. A majority of the cutter assemblies are mounted on the front walls of radial spoke beams, which beams form part of the structure of the cutterhead. Other cutter assemblies are mounted on the front side of an auxiliary frame structure which is angularly offset from the radial spoke beams.

A second type of open face cutterhead is disclosed by the aforementioned publication of Carlo Grandori and by U.S. patent application Ser. No. 934,978 filed Aug. 18, 1978, by Carlo Grandori and assigned to The Robbins Company. This second type of open face rotary cutterhead includes a plurality of forwardly open, radially extending troughs. Roller cutters are mounted within the troughs to cut concentric kerfs upon rotation of the cutterhead. Segments which form breasting ring occupy the regions of the cutterhead between the radial troughs. The Grandori publication states that the rings support loose material against the tunnel face so that such material can be broken up into small enough pieces to thereby prevent damage to the tunneling machine. Accordingly, the ring segments are raised above the bottom of the trough to an elevation which permits the cutting edges of each cutter to project slightly forwardly of the ring segments. With reference to the direction of rotation of the cutterhead, the trailing end portion of each ring segment is fixedly attached to a shovel which forms the front wall of each radially extending trough. Fractured ground material theoretically passes rearwardly through the cutterhead through annular openings located between adjacent ring segments.

A disadvantage of this particular type of cutterhead stems from the fact that the "rings" are composed of segments and thus are not continuous. Pieces of rock which are too large to pass through the annular openings between the rings segments slides along the length of said openings until they abut against the shovel wall located at the terminal end portions of each ring segment. Thereupon, the large chunks of rock either damage the cutterhead as it continues to rotate or wedge so tightly between the front of the cutterhead and the face of the tunnel that the cutterhead is prevented from rotating, thus requiring the tunneling machine to be retracted so that such chunks of rock material can be manually broken up.

Furthermore, some of the individual ring segments in this second type of cutterhead are not of uniform width, but are wider near the terminal end portion of the ring segment; correspondingly, the annular openings are narrower in these areas. Thus, pieces of fractured rock which slide along the annular openings become wedged between the ring segments and are thereby prevented from freely passing rearwardly through the cutterhead.

A third type of open face cutterhead is disclosed by the aforementioned co-pending U.S. patent application Ser. No. 931,384. This particular cutterhead, which was developed in order to complete the subject invention, includes a plurality of radial spoke beams which are interconnected between a box-like hub structure and an annular box beam. Each radial spoke beam is constructed of a pair spaced apart side plate members. Mounts for mounting roller cutters on the cutterhead are receivable between and integrally connected to the side plate members to thereby also function as structural braces for the radial spoke beams. The cutterhead frame and the roller cutter mounts are configured to permit installation and removal of the roller cutters from the rear side of the cutterhead. The cutterhead also includes radially elongate scoops for collecting the fractured material and depositing it on a conveyor for removal rearwardly through the tunnel.

The above described patents together with the prior that was cited and considered by the Patent Office before granting them, and which is listed on the patents, along with the other prior art disclosed above, should be consulted for the purpose of properly evaluating the subject invention and putting it into proper prospective relative to the prior art.

SUMMARY OF THE INVENTION

The present invention relates to a novel open faced rotary cutterhead for an earth boring machine. In basic form, according to an aspect of the present invention, the rotary cutterhead is constructed of a main frame comprising an annular beam by which the cutterhead is mounted onto an earth boring machine for rotation about an axis of rotation. The main frame includes a plurality of radial spoke beams, each including a pair of spaced apart side plate members defining spaces between them. Each of the side plate members extend generally radially outwardly at the front of the cutterhead and then curves rearwardly to form longitudinally extending outer end portions which intersect with the annular beam. Cutter mounts for mounting roller cutters are receivable in the spaces defined by each pair of side plate members. The roller cutters include a gauge cutter mounted between the rearwardly extending radially outer end portions of the side plate members of at least some of the radial spoke beams. The cutter mounts are adapted to permit installation and removal of the roller cutters from the rear side of the cutterhead. Furthermore, the main frame is configured to provide interior space within the cutterhead which is large enough to provide room to allow installation and removal of the rollers, including the gauge cutters, from behind the cutterhead.

According to an aspect of the invention, the cutterhead is provided with a plurality of generally radially elongate cut-ground-material passageways which extend through the cutterhead in regions between the radial spoke beams. The location and configuration of the passageways enables ground material to pass directly rearwardly through the cutterhead from the particular location of the tunnel face from which the material is cut or fractured by the roller cutters.

According to an aspect of the invention, a plurality of concentric, radially spaced apart face-support-ring members are located forwardly of the cutterhead main frame in at least the radial region of the cutterhead in which the cut-ground-material passageways are located. The roller cutters, which are positioned to cut concentric kerfs upon rotation of the cutterhead, are disposed so that their peripheral cutting edge portions project forwardly of the face-support-ring members. Each of the face-support-ring members are substantially circumferentially continuous except where such continuation of a ring member would interfere with the proper placement of a roller cutter whereupon the face-support-ring member is cut away a minimum amount which is sufficient to accommodate the interfering roller cutter. The ring members are radially spaced apart a distance sufficient to permit rocks of a desired maximum size to pass there between and then into the cut-ground-material passageways. Furthermore, the construction of the face-support-ring members not only prevents loose material at the tunnel face from collapsing at a rate faster than the rate at which such material can pass through the cutterhead, but also permits chunks of rock which are too large to pass directly between the ring members to slide circumferentially over the front face of the ring member or between adjacent ring members until they reach a cutter whereupon the chunks are broken up into small enough pieces to pass through the adjacent ring members. Because the ring members are continuous and also because each annular opening between adjacent ring members is of constant width, pieces of rock are free to slide along between adjacent ring members while only making line contact with the edges of such ring members.

According to an aspect of this invention, the front of the cutterhead is closed off in all regions except within the roller cutter mounts or within the cut-ground-material passageways.

According to an aspect of the invention, radially disposed scraper cutters are positioned between adjacent face-support-ring members at the trailing edge of each cut-ground-material passageways front openings. Each of the scraper cutters has a leading blade or tip portion which projects forwardly of the face-support-ring members, but rearwardly of roller cutter peripheral cutting edge portions. Locating the scraper cutters at the trailing edge of the passageway openings does not block off or hinder fractured material which travels between the ring members from entering into the passageways.

According to an aspect to the invention, wear beads are deposited in a grid pattern over the front face of each of the face-support-ring members. The wear beads are formed from material which is substantially harder than the material from which the corresponding face-support-ring members are constructed to thereby protect the face-support-ring members. from abrasion by the rocks being excavated during operation of the cutterhead.

According to an aspect of the invention, a plurality of scoop walls are located within the interior space of the cutterhead and orientated such that the plane of each scoop wall is disposed both perpendicularly to the circumference of the annular beam and radially about the axis of rotation of the cutterhead. One each of the scoop walls extend between the forwardly directed surfaces of the annular beam and the corresponding rearwardly and radially inwardly directed portions of each of the radial spoke beams.

It is a primary object of the present invention to provide an open face rotary cutterhead for an earth boring machine which efficiently cuts or breaks up ground material into a size small enough to permit passage of such material through the cutterhead and then to permit conveyence of such material rearwardly through the tunnel being bored without damaging either the cutterhead or the conveying machinery.

Another object of the present invention is to provide a rotary cutterhead capable of supporting loose ground material at the front face of the tunnel while said ground material is being broken up by the roller cutters to thereby prevent the front face of the tunnel from collapsing.

A further object of the present invention is to provide openings within the rotary cutterhead to permit passage of the ground material through the cutterhead without trapping or wedging such material between the cutterhead and the tunnel face so that the cutterhead is not prevented from rotating.

One more object of the present invention is to provide cutter mounts for roller cutters which permit the fractured ground material to pass through the cutterhead between the roller cutter and the cutter mount.

Yet another object of the present invention is to provide a rotary cutterhead having portions which are treated with hardened materials to prevent rapid abraision of the cutterhead by the ground materials being fractured.

BRIEF DESCRIPTION OF DRAWINGS

In the drawings, like element designations refer to like parts throughout, and

FIG. 2 is a front elevational view of the typical cutterhead;

FIG. 6 is a fragmentary cross-sectional view of the cutterhead shown in FIG. 1 taken substantially along lines 6—6 thereof;

FIG. 7 is an enlarged fragmentary cross-sectional view of the cutterhead shown in FIG. 6 taken substantially along lines 7—7 thereof;

DESCRIPTION OF THE PREFERRED EMBODIMENT

Figure 1:
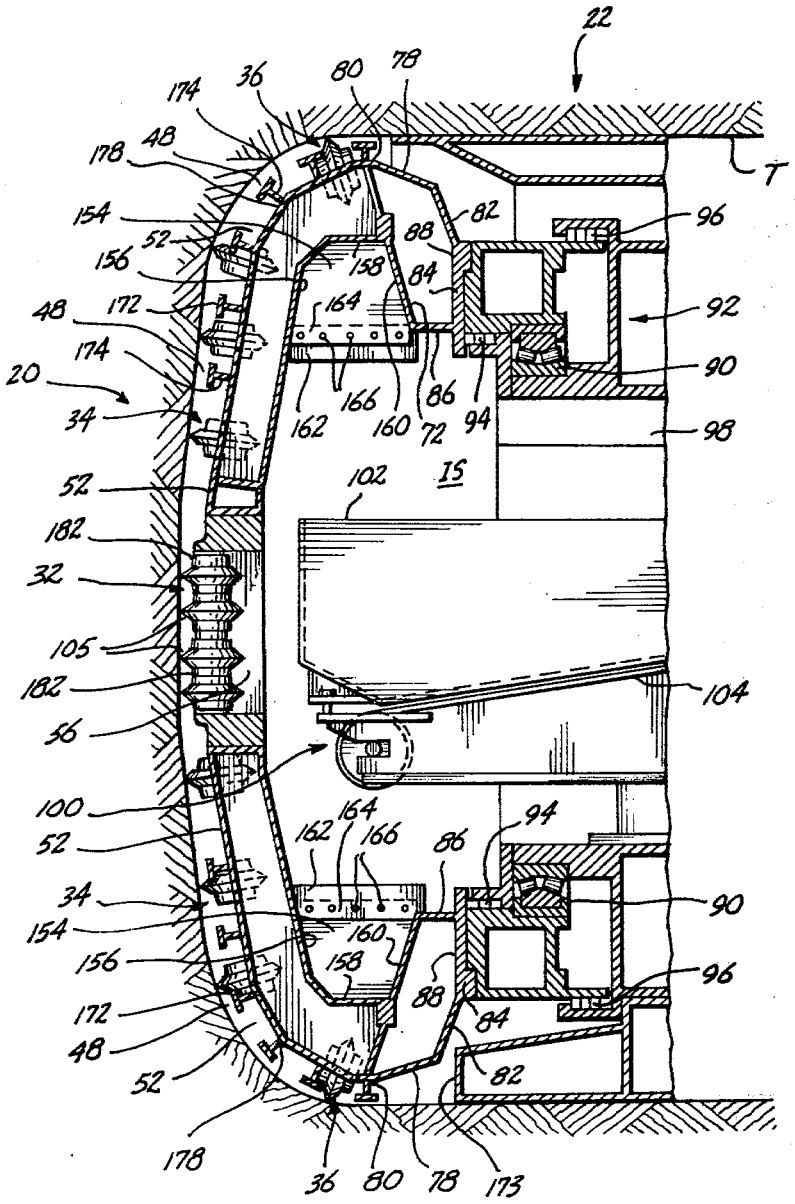
FIG. 1 is an enlarged fragmentary side elevational view illustrating a typical cutterhead constructed according to the present invention together with portions of the cutterhead support of a tunnel boring machine, with some parts in axial section.

Referring initially to FIG. 1, shown in side elevational view is a typical rotary cutterhead 20 constructed according to the present invention and which is also the best mode of the invention current known to applicant. Cutterhead 20 is mounted on the front portion of a tunneling machine 22 for rotation about an axis generally corresponding to the longitudinal center line of the tunnel T being bored. The advance direction of tunneling machine 22 is coincident to the rotary axis of the cutterhead 20 and the tunneling machine 22 follows the cutterhead 20 into the opening formed by said cutterhead.

Figure 3:
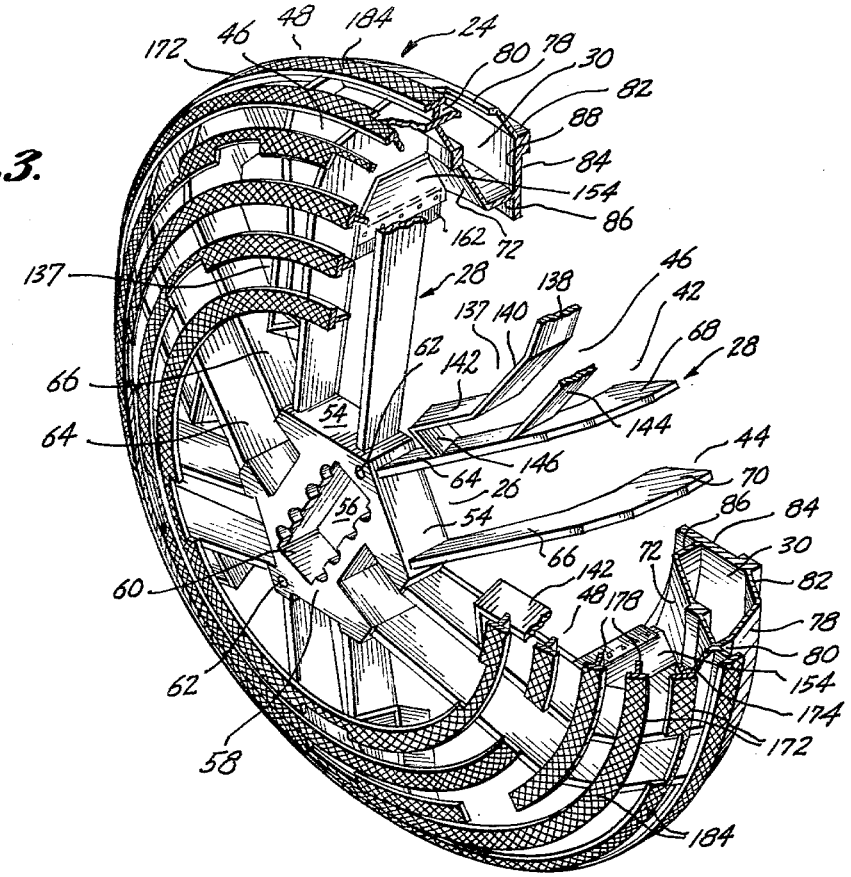
FIG. 3 is an isometric view taken from the front and looking downwardly toward the upper and side portions of a typical cutterhead frame, with a foreground portion of such frame cut away.
Figure 4:
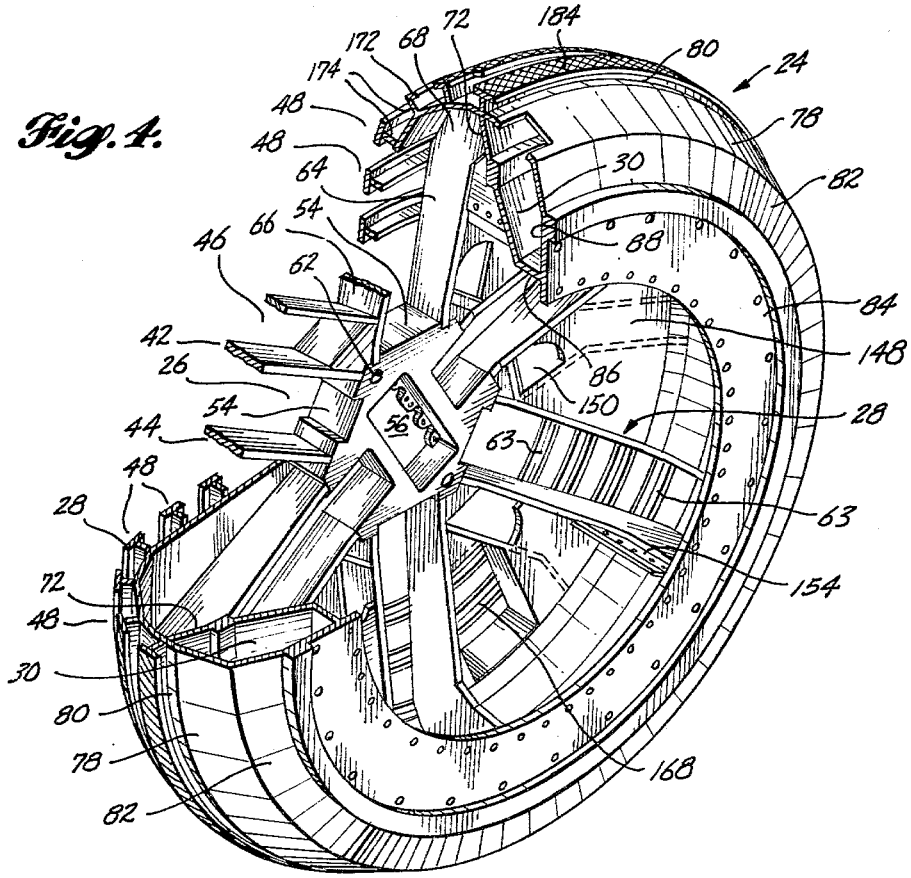
FIG. 4 is a view similar to FIG. 3, but directed towards the rear side of the typical basic cutterhead frame, with an upper foreground portion of such frame cut away.
Figure 5:
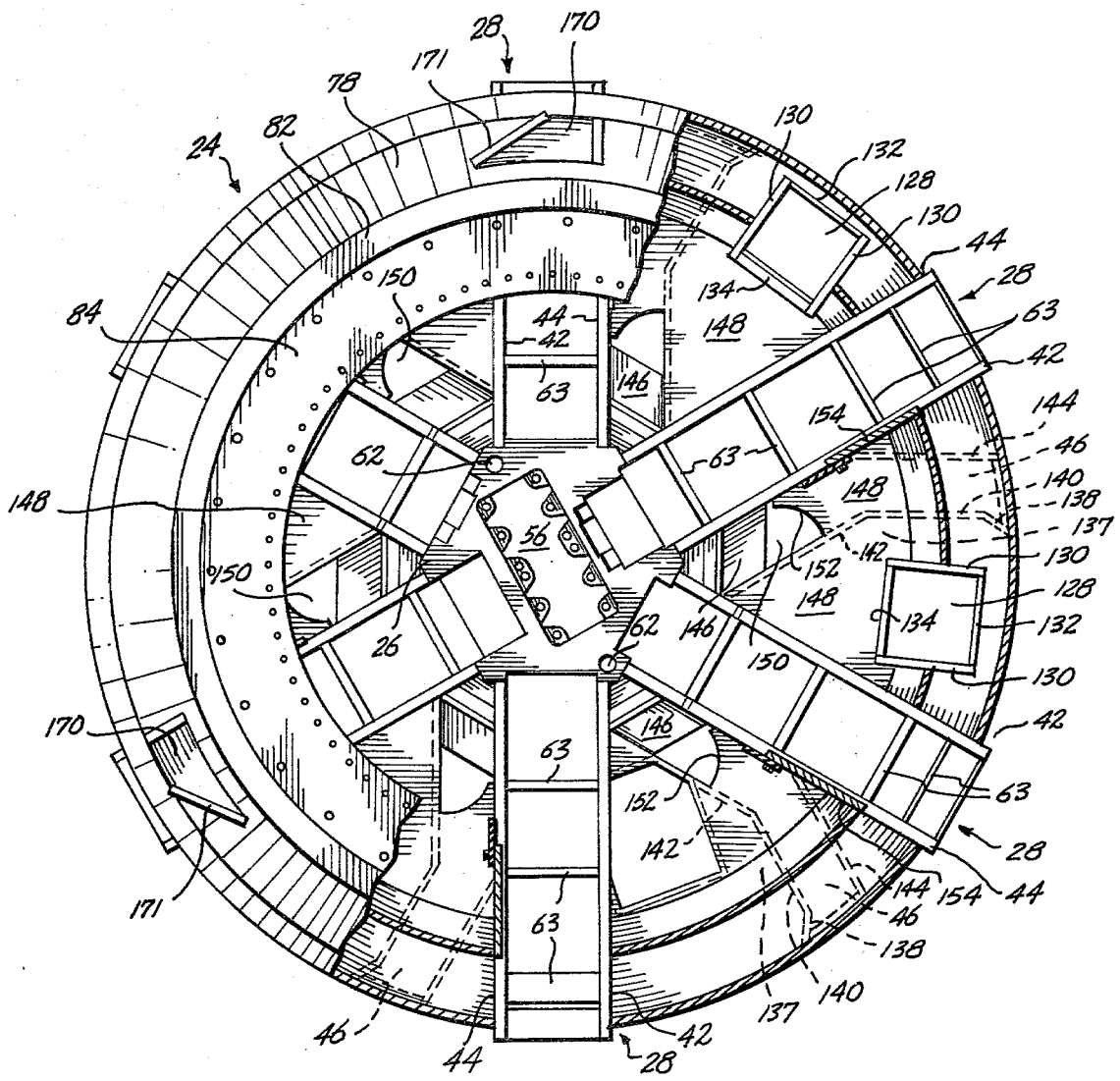
FIG. 5 is a rear elevational view of the typical basic cutterhead frame shown in FIG. 4 with portions broken away.
Figure 8:
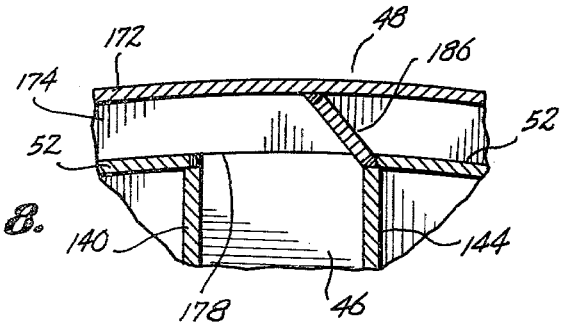
FIG. 8 is an enlarged, fragmentary cross-sectional view of the cutterhead shown in FIG. 6 taken substantially along lines 8—8 thereof.

In the preferred form illustrated, cutterhead 20 comprises a main frame 24 which, as best illustrated in FIGS. 3-5, includes a central hub structure 26 from which six individual radial spoke beams 28 extend radially outwardly and then rearwardly to intersect with an annular member in the form of annular box beam 30 by which box beam the cutterhead 20 is mounted on tunneling machine 22. A center cutter assembly 32 is mounted within central hub 26, and a plurality of individual intermediate cutters 34 and gauge cutters 36 and their associated cutter mounts 38 and 40, respectively, are receivable between corresponding side plate members 42 and 44 of each of said spoke beams 28. Cutterhead 20 also includes a plurality of generally radially elongate cut-ground-material passageways 46 and a plurality of concentric, radially spaced apart face-support-ring members 48 which are disposed forwardly of and overlie cutterhead main frame 24. As shown in FIGS. 2, 6 and 7, a radially disposed scraper cutter 50 is positioned between adjacent face-support-ring members 48 at the trailing edge of each cut-ground-material passageway. Except in the areas within the cut-ground-material passageways 46 and within each cutter mount 38 and 40, the front face of the main frame 24, as shown in FIGS. 1 and 2, is covered by plating 52.

Now referring specifically to FIGS. 3-5, main frame 24 includes a plurality of radial spoke beams 28 which are interconnected between a box-like central hub structure 26 and an annular box beam 30 in a manner somewhat similar to the cutterhead main frame disclosed by aforementioned U.S. patent application Ser. No. 931,384. Hub structure 26 is generally hexagonal in shape and includes six peripheral walls 54 oriented such that a one spoke beam 28 radiates outwardly from each of said walls 54. The shape of hub structure 26 and the corresponding number of spoke beams 28 are dependent on the relative radial placement and the total number of cutters 34 and 36 which are required for a cutterhead of a particular size and for the particle ground material being excavated. A rectangularly shaped opening 56 extends through the center of hub 26, which opening 56 is reduced in size at the hub front wall 58 by window 60. Also, two circular holes 62 extended through opposite portions of the peripheral edges of hole structure 26.

Each radial spoke beam 28 includes a pair of side plate members 42, 44 disposed in spaced parallel relationship to each other by a plurality of partition or cross walls 63 which transversely connect and are spaced along the length of said side plate members 42, 44. The inner end of each of the side plate members 42, 44 fixedly abuts against hub peripheral walls 54 at the corners of said peripheral walls 54 so that adjacent side plate members 42 and 44 of adjacent spoke beams 28 intersect each other at such corners. Each member 42, 44 includes a forward section 64, 66, respectively, that radiates outwardly from hub structure 26 while lying in a plane perpendicular to the tunnel axis, FIGS. 3 and 4. At their outer ends, each side plate member 42, 44 curves rearwardly to form outer end sections 68 and 70, respectively, which outer end sections fixedly abut against frustro-conical shaped forward wall 72 of annular box beam 30. However, the location of the foreward sections 64, 66 and the outer end sections 68 and 70 corresponds to the front or forward portion of cutterhead 20 which front or forward portion includes both the generally vertical face portion and the peripheral or gauge portion of said cutterhead 20. As best shown in FIG. 1, the front edges of side plate members 42 and 44 generally follow the desired contour of the tunnel face which is preferrably cut in a relatively flat crown shape with a generally circular curvature existing at its outer circumference.

In addition to forward wall 72, annular box beam 30, as illustrated in FIGS. 1, 3 and 4, also includes frustro-conical peripheral first wall 78 and second wall 80. Second wall 80 intersects the outer or circumferential edge of forward wall 72. A frustro-conical outer rear wall 82 extends radially inwardly from the rear edge or perphery of first wall 78 to intersect mounting ring 84, which ring serves as a lower rear wall. Lastly, a cylindrical inner wall 86 interconnects the radially inwardly edge of forward wall 72 and the front face 88 of mounting ring 84.

Constructing main frame 24 with rearwardly curving spoke beams 28 and annular box beam 30 provides a sufficient amount of interior space I.S. within cutterhead 22 to allow workmen to enter into interior space I.S. to install and remove all of the cutters 32, 34 and 36 from behind said cutterhead 20.

Refering now to FIG. 1, cutterhead 20 is supported for rotation by a large diameter bearing 90 that is mounted on cutterhead support 92 in a manner similar to that disclosed in previously mentioned U.S. patent application Ser. No. 931,384. Correspondingly, dirt seals 94 and 96 are provided between the rotating and nonrotating parts at each end of bearing 90. Furthermore, the cutterhead support 92 includes a central, axial passageway 98 through which passageway extends the front portion of a conveyor assembly 100, including its associated hopper 102. Hopper 102 collects the ground material fractured by cutterhead 20 and then deposits such ground material on conveyor belt 104 for removal rearwardly through tunneling machine 22 and tunnel T.

As best shown in FIGS. 1 and 2, the center cutter assembly 32 is mounted within hub opening 56 from the rear of hub structure 26 in a manner similar to that illustrated in U.S. patent application Ser. No. 931,384. The center cutter assembly 34 in the embodiment illustrated includes four aligned disc cutters 105. Clearance space exists between each disc cutter 105 and the perimeter of hub window 60 to permit ground material, which is fractured and cut by said disc cutters 105 to pass rearwardly through opening 56.

Single intermediate disc cutter units 34 and single gauge disc cutter units 26 are mounted within their corresponding mounts 38 and 40. Mounts 38 and 40 in turn are fixedly positioned between spoke beam side plate members 42 and 44 so that the peripheral cutting edges 106 of said cutters 34 and 36, and of center cutters 105, cooperate to cut concentric kerfs in the tunnel face as cutterhead 20 rotates. Each disc cutter 34, 36 and 105 also includes sloping breaker surfaces 108 flanking said circumferential cutting edge 106 for fracturing the rock material at the tunnel face.

Figure 9:
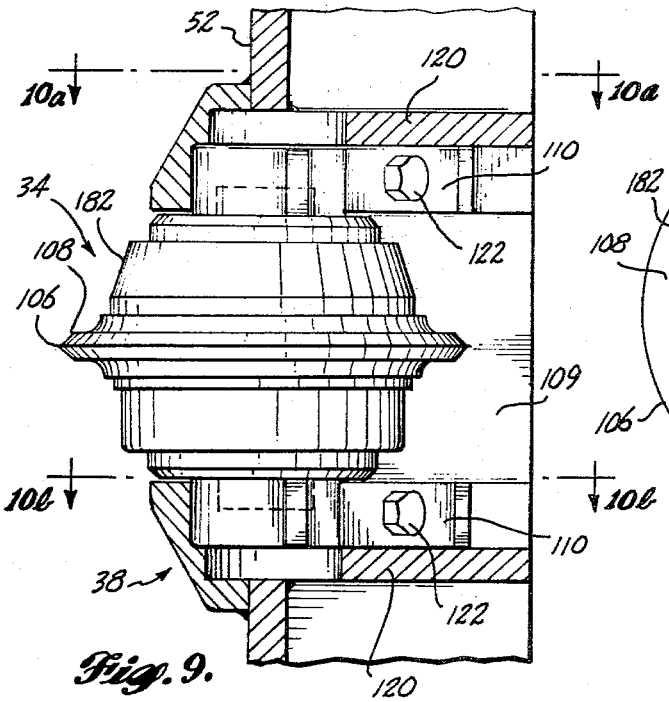
FIG. 9 is an enlarged fragmentary view, partially in section and partially in elevation, of typical intermediate roller cutter exemplifying one method of mounting the cutter.
Figure 10:
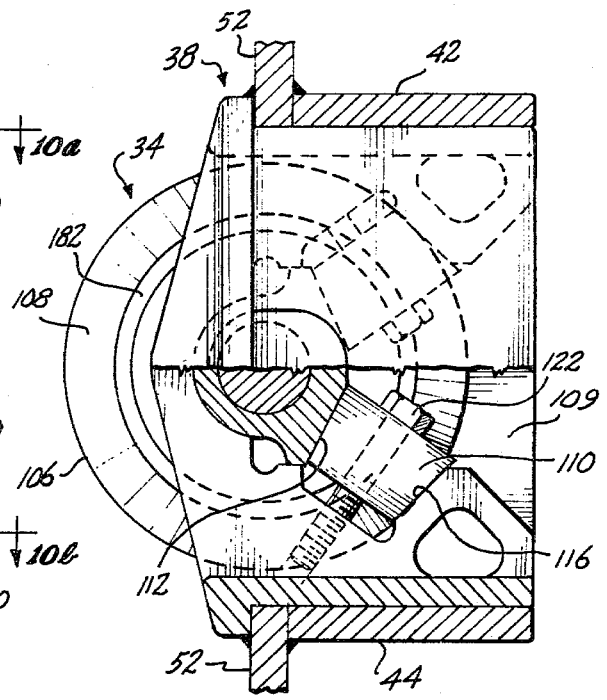
FIG. 10 is a split cross-sectional view, wherein the outer portion is taken along line 10*a*—10*a* of FIG. 9 wherein the lower portion is taken along line 10*b*—10*b* of FIG. 9
Figure 11:
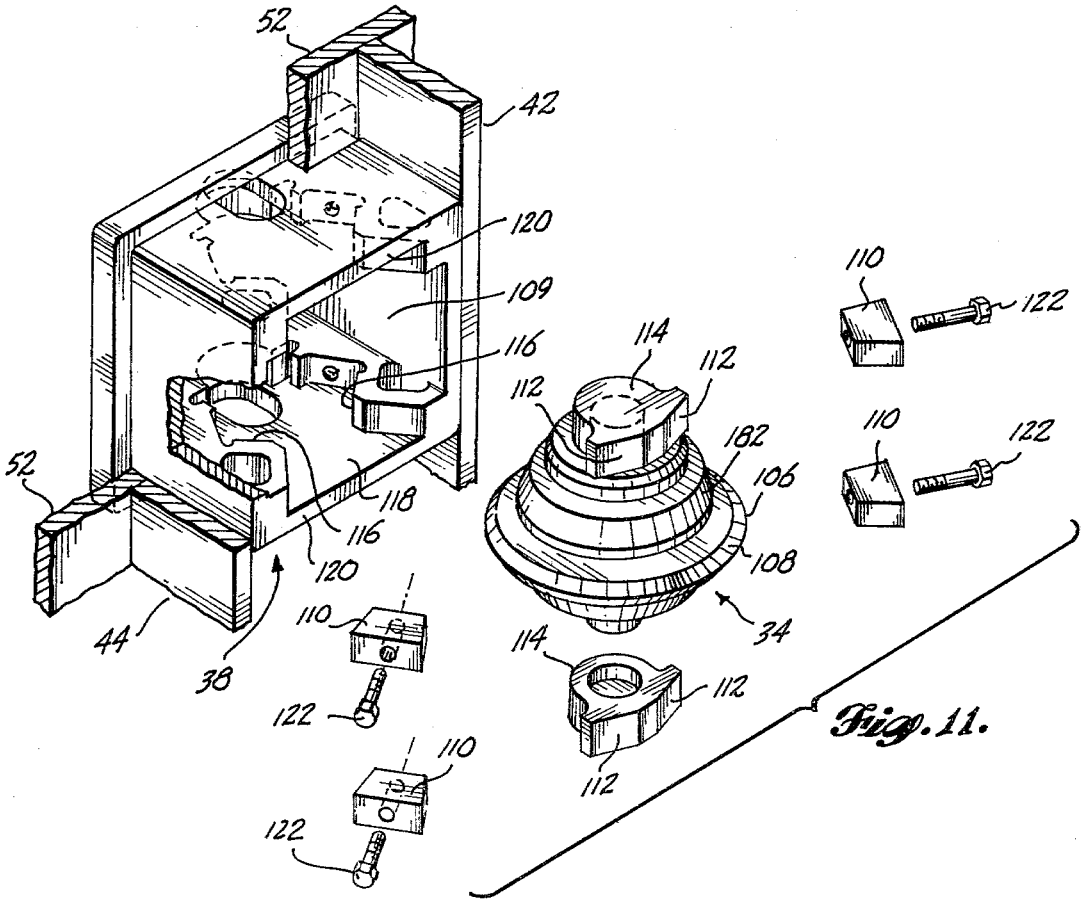
FIG. 11 is an exploded isometric view of the typical intermediate cutter and its corresponding mounting structure.

Each cutter mount 38, as illustrated in FIGS. 9–11, includes a box shaped structure which is welded in place between th side plate members 42 and 44 and between adjacent partitions 63 to form a cutter compartment or well 109. Clearance exists between each cutter 34 and its corresponding well 109 to permit fractured ground material to pass rearwardly therethrough. In a manner similar to that illustrated in U.S. patent application Ser. No. 910,561 and in Ser. No. 931,384, each cutter well 109 is constructed to receive cutter 34 from behind cutterhead 20 and also to retain said cutter 34 within said well 109 through the use of load transferring blocks 110. Blocks 110 are positioned between the rearwardly directed face 112 of each cutter end member 114 and a corresponding forwardly directed face 116 of channels 118 formed in each end wall 120 of each well 109. Once load transferring blocks 110 are in place, capscrews 122 can be inserted through clearance openings provided said blocks 110 and then engaged with threaded blind holes provided in end walls 120. Thus, since each end wall 120 forms an integral portion of the main frame 24, thrust loads imposed on cutters 34 are transmitted in compression through load transfer blocks 110 directly to said cutterhead main frame 24.

Furthermore, the construction of each gauge cutter 36 and its associated mount 40 is similar to the construction of the above described intermediate cutter 34 and intermediate cutter mount 38.

As shown most clearly in FIG. 2, a plurality of auxiliary disc type roller coutters 124 are located within the region of cutterhead 20 between adjacent spoke beams 28. In a manner corresponding to the above described intermediate cutters 34 and gauge cutters 36, each auxiliary cutter 124 is mounted within its corresponding mount 126, which is illustrated as including a box shaped well 127 fixedly positioned within a correspondingly shaped framed opening 128, FIG. 5. Opening 128 is formed in part by a pair of side walls 130 spaced apart in parallel relationship. Each of said side walls 130 extends rearwardly to abut against annular box beam forward wall 72 in a manner similar to side plate member outer end sections 68 and 70. Furthermore, each framed opening also includes an outer end wall 132 and an inner end wall 134, which two walls are spaced apart in parallel relationship and are disposed perpendicularly to a radius line beginning at the rotational center of main frame 24 and extending radially outwardly through the center of each framed opening 128.

In a manner similar to cutters 34 and 36, auxiliary cutters 124 can be removed from, and replaced within, well 127 from the back side of main frame 24. Correspondingly, clearance space exists between each auxiliary cutter 126 and its corresponding well 127 to permit fractured material to pass rearwardly through said space. Furthermore, each auxiliary cutter 124 has a peripheral cutting edge 106 and sloping breaker surfaces 108 flanking said peripheral cutting edge 106 to cooperate with disc cutters 34, 36 and 105 to cut concentric kerfs within the tunnel face.

As shown in FIGS. 2 and 3, cutterhead 20 includes a plurality of radially extending cut-ground-material passageways 46 extending transversly through said cutterhead 20 in regions between adjacent radial spoke beams 28. Each passageway 46 initiates from a central location near hub structure 26 and then extends generally radially outwardly to terminate at the outer circumference of annular box beam 30. Each of said passageways 46 includes a leading wall 137 formed by an outward segment 138, an intermediate segment 140 and an inward segment 142, which inward segment 142 is disposed substantially parallel to the adjacent spoke beam side plate member 42. Each passage way 46 also includes a outward trailing wall 144, which wall 144 is disposed substantially parallel to leading wall intermediate segment 140. The inner end of each trailing wall 144 diagonally intersects with a corresponding spoke beam side plate member 42, which side plate member 42 also forms an inward section of the trailing wall of each passageway 46. The depth of passageway leading wall 137 and outward trailing wall 144 is equal to the depth of spoke beam side plate members 42 and 44; thus, the rearwardly directed edges of leading wall segments 138 and 140 and the rearwardly directed edge of trailing wall segment 144 intersect the forward wall 72 of annular box beam 30 in a manner similar to spoke beam side plate members 42 and 44.

As most clearly shown in FIGS. 2 and 3, the outer radial end of each passageway 46 is open to permit entrance of fractured ground material which may be located about the circumference of cutterhead 20. The inner end of each passage way 46 is formed by a sloped inner end wall 146 which is disposed perpendicularly to leading wall intermediate segment 140 and which intersects the inward end of the inward segment 142 of leading wall 136 and a corresponding spoke beam side plate member 42.

As most clearly shown in FIG. 5, almost the entire rear of each passageway 46 is closed off by plating 148, with the exception of a circular segment shaped opening 150 formed by leading wall inward segment 142, inner end wall 146 and arcuate edge 152 of plating 148.

A large portion of the fractured ground material, which travels rearwardly through passageways 46, reaches the interior of cutterhead 20 while the particular passageway 46 is in the upper part of its rotation; thus, the material drops directly into hopper 102. Most of the remainder of the cut ground material reaches the interior of cutterhead 20 when its corresponding passageway 46 is in the lower part of the rotation of said cutterhead 20 and thus is scooped or carried upwardly along the inside perimeter of said cutterhead 20 by a series of scoop walls 154, FIGS. 1, 4, and 4. Said scoop walls 154, as best illustrated in FIG. 1, has a front edge 156 and an outward edge 158, which two edges abut against adjacent edges of a corresponding spoke beam side plate member. Each scoop wall 154 also includes a rear edge 160 which abuts against the adjacent portion of forward wall 72 of annular beam 30. Thus, it can be seen that each scoop wall 154 lies essentially coplanar with a corresponding spoke beam side plate wall 42. A lip 162, constructed of flexible, resiliant material, is sandwiched between the inward edge portion of each scoop wall 154 and a rectangularly shaped plate 164 through the use of capscrews 166 which extend through clearance holes provided in said plate 164 and then thread into aligned, tapped through holes provided in such inward edge portions. Lips 162 function to provide a seal between it associated wall 154 and the corresponding stationary portions of tunneling machine 22 which partially surrounds the hopper 102 to there by prevent fractured ground material from sliding inwardly off said scoop wall before reaching an elevation high enough to drop into said hopper 102. The portion of the tunneling machine which lips 162 wipe against do not form part of the present invention.

Now referring specifically to FIGS. 1 and 2, almost the entire front and circumferential faces of main frame 24 are covered by plating 52. The only areas not covered by plating 52 are the areas within central hub opening 56; cutter mounts 38, 40 and 126, cut-ground-material passageways 46, rectangular shaped front opening 168. Opening 168 is provided to permit workmen to crawl through to the front side of cutterhead 20, for instance, in an emergency situation. The overlying portion of face-support-ring member 48 will, however, first has to be removed. Also, there are three generally rectangularly shaped circumferential openings 170 within plating 162. Said openings 170, as illustrated in FIG. 5, are spaced around the circumference of cutterhead 20 and extend through the portion of cutterhead 20 corresponding to first peripheral wall 78 and the outer rear wall 80 of annular box beam 30. Furthermore, a plate 171 is positioned at the trailing edge of each circumferential opening 170 to extend slightly rearwardly of the rear surface of outer rear wall 80 of annular box beam 30, FIG. 5. Circumferential openings 170 permit material which has collected at the rear side of cutterhead 20 to enter into the interior of said cutterhead as such material is pushed ahead by forward facing wall 173 of cutterhead support 92, FIG. 1.

Referring now to FIGS. 1–3, 7 and 8, a plurality of concentric, radially spaced apart face-support-ring members 48 overlie almost the entire front and circumferential or guage regions of the cutterhead main frame 24 except in the center area of said main frame near hub structure 26. Thus, said face-support-ring members 48 are located in at least the radial region of cutterhead 20 in which the cut-ground-material passage ways 46 are located, including regions in which gauge cutters 36 are positioned. Ideally it would be preferable to place face-support-ring members 48 even in the central area of the cutterhead main frame 24. However, placement of such ring members 48 in the central area of main frame 24 would not be beneficial unless the cut-ground-material passageways 46 could also be extended radially inwardly a corresponding amount. Extension of passageways 46 in the typical cutterhead 20 illustrated was not possible because of the presence of a rather large central hub structure 26 which is required to provide adequate structural support for the center of said cutterhead 20.

In cross section, each ring member 48 includes an outwardly projecting face section in the form of flange member 172, which flange member is disposed tangentially to the envelope defined by the peripheral cutting edges 106 of disc cutters 34, 36, 105 and 124, which envelope corresponds to the desired profile of the tunnel face. Each ring member 48 also includes an integral, inwardly directed shank section in the form of web member 174, which web member cooperates with its corresponding flange member 172 to form identical T-shaped cross sections. Constructing each ring member 48 in this manner with a flange member 172 which is wider than the corresponding web member 174 provides an enlarged space into which cut-ground-material can expand. Thus, it is to be understood that all of the face-support-ring members 48 do not have to be of the same cross-sectional size or even of the same cross-sectional shape, as long as each individual ring member 48 is of uniform cross-sectional size and as long as the face portion of each ring member 48 is wider than its shank portion. The free or inward edge portion 178 of each web member 174 is fixedly attached to corresponding portions of spoke beam 28, front plating 52 and cutter mounts 38, 40 and 126 which directly underlie said edge portion 178.

The ring members 48 are positioned outwardly of front plating 52 a distance sufficient to permit the peripheral cutting edge 106, which encircles the annular rim 182 of each disc cutter 34, 36, 105 and 124, to project slightly forwardly of ring members flange sections 172 as shown in FIG. 1. Face-support-ring members 48 are spaced apart so that the annular openings between them are of constant width so that chunks of rock which are too large to pass directly through cut-ground-material passageways 46 can freely slide along adjacent ring members 48, while making only line contact with flange members 172, until such chunks are broken up into smaller pieces by disc cutters 34, 105 or 124 or by scraper cutters 50. Preferably the spacing between adjacent ring members 48 progressively decreases as the radial distance from the center of cutterhead 20 increases. This change in spacing is required to compensate for the fact that due to the force of gravity, more rock material tends to fall downwardly into the peripheral regions of cutterhead 20 than in the central portion of said cutterhead 20. Thus, the narrower spacing between the peripherally located face-support-ring members tends to force some of the rock material to migrate toward the center of cutterhead 20 whereat such material can be accommodated. As illustrated, ring members 48 are spaced apart a distance sufficient to permit from two to three peripheral cutting edges 106 to be disposed between adjacent ring member flanges 172 which thus also limits the size of fractured particles which can pass between said adjacent ring members 48. Preferably the size of such particles should be large enough so that excessively repetitous cutting by cutters 34, 36, 105 and 124 is not required while small enough to permit conveyor 104 to handle such particles without being damaged.

Ring members 48 also function to support the tunnel face to thus prevent loose material from falling away from the tunnel face at a rate faster than at which such material can pass rearwardly through cutterhead 20 or at a rate faster than such material can be handled by conveyor 104. Correspondingly, each ring member 48 is constructed to be substantially circumferentially continuous except where continuation of a ring member 48 would interfere with proper placement of a disc cutter 34, 36, or 124. Where possible, ring members 48 are only notched a minumum amount which is sufficient to permit clearance for the interferring disc cutter peripheral cutting edges 106. Also, instead of discontinuing a ring member in the areas shown in FIG. 2, said ring members could be provided with a close fitting hole through which peripheral edge 106 of said disc cutters 43, 36 or 124 could protrude. Thus, as cutterhead 20 rotates, fragments of ground material that have only partially passed through the openings between adjacent ring members 48 are free to slide along between the edges of ring member flanges members 172 until they are broken up into a sizes which are small enough to pass between said adjacent ring members 48. Furthermore, material which does not fall between adjacent ring members 48 is free to ride along over the face of flange members 172 until such material encounters and is fractured by a disc cutter 36, 105 or 124. Since flange members 172 are relatively narrow, they do not impart a large frictional resisting force against the tunnel face thereby permitting unrestricted relative movement between fractured material and the front face of said flange members 172.

A grid of wear beads 184, as shown in FIGS. 2–4, is deposited, for instance by welding, in a cross-hatched patern over the entire outward surface of each ring flange member 172 to form diamond shaped paterns. Said wear beads 184 are composed of material which is substantially harder than the material from which the ring members 48 themselves are constructed to thereby protect flange members 172 from abrasion by rocks when the cutterhead 20 of the present invention is in use.

Now referring to FIGS. 2, 6 and 7, a plurality of scraper cutters 50 are positioned along the trailing edge of the forward opening of each passageway 46. Said scraper cutters 50 are mounted on a mounting plate 186; one each of said mounting plates 186 are disposed along the trailing edge of each passageway 46. Furthermore, each mounting plate 186 extends outwardly from front plating 52 and is canted forwardly toward the direction of rotation of cutterhead 20 to intersect the rearward surfaces of overlying face-support-ring members 48 to thereby form a stop or barrier for materials which may be sliding along the annular opening between adjacent ring members 48 and to direct such material into a passageway 46, FIGS. 7 and 8. Each scraper cutter 50 is closely receivable between adjacent face-support-ring members flange members 172 and projects forwardly of said flange members 172 but rearwardly of cutter peripheral edges 106.

Furthermore, each scraper cutter 50 has a shank portion 190 which overlaps the corresponding leading surface of mounting plate 186, and a pointed tip or blade portion 192 which projects outwardly of and overlaps the leading edge portion 194 of each mounting plate 186 FIGS. 6–9. Each of said scraper cutters 50 is detachably mounted on mounting plate 186 by capscrews 196 which extend through clearance holes provided in said mounting plate 186 and then tread into aligned, tapped through holes provided in shank portion 190 of each of said scrapers cutters 50 thereby permiting said scraper cutters to be replaced when required. However, since the blade portion 192 is constructed of hardened material and is considerably thicker than, for instance the the peripheral cutting edges 106 of disc cutters 34, it is contemplated that cutters 50 will have to be seldon replaced, if ever. Moreover, cutters 50 can be removed when, for instance, the particular characteristics of the ground material being bored does not require their use.

As best shown in FIG. 2, cutterhead 20 also includes a plurality of forwardly directed nozzles 198 positioned adjacent oppositely extending spoke beams 28 for discharging or spraying water forwardly toward the face of tunnel T to minimize the dust generated during operation of said cutterhead 20. Nozzles 198 are interconnected in fluid flow communication with each other through the use of hoses 200, which hoses 200 are covered for protection by angle members 202. It is to be understood that other types of conduits, such as pipes, could be substituted for hoses 200.

In operation, as cutterhead 20 is rotated and simultaneously advanced by tunneling machine 22, disc cutters 34, 36, 105 and 124 cut concentric kerfs into the tunnel face so that the slopping breaker surfaces 108 flanking the circumferential cutting edges 106 fractures and dislodges the rock material located between the kerfs. The fractured rock material then travels rearwardly through cutterhead 20 by passing between adjacent face-support-ring members 48 and then through passageways 46.

Material which is too large to pass directly between adjacent ring members 48 can slide along the annular opening defined by said adjacent ring members 48 until such material reaches a scraper cutter 50. Scraper cutter 50 thereupon fractures the material into a small enough size to pass between said adjacent ring members 48. Furthermore, said ring members 48 serve to support loose, large chunks of rock material against the face of the tunnel until such material can be broken up by disc cutters 34, 36, 105 and 124 and by scraper cutters 50. When the rock material reaches the interior of cutterhead 20, such material either drops directly into hopper 102 or is lifted or carried upwardly along the inside perimeter of cutterhead 20 by scoop walls 154 until such material is raised high enough to slide downwardly into hopper 102 and then onto conveyor 104 to be transported rearwardly through tunnel T.

What is claimed is:

1. A rotary cutterhead for an earth boring machine, comprising:

a. a main frame having a forward section and a rearward section by which rearward section the cutterhead is mounted onto an earth boring machine for rotation about an axis of rotation;

b. a plurality of roller cutters and cutter mounting means for mounting said roller cutters within said main frame forward section, each of said roller cutters having peripheral cutting edge portions projecting forwardly of said main frame forward section to cut concentric kerfs upon rotation of the cutterhead;

c. a plurality of cut-ground-material passageways formed in said main frame forward section and disposed between said roller cutters, and extending through said main frame; and, d. a plurality of radially spaced apart face-support-ring members located on the cutterhead, each of said face-support ring members projecting forwardly of said main frame forward section and slightly rearwardly of said roller cutter peripheral edges, and being circumferentially continuous except where such continuation of a face-support-ring member would interfere with the proper placement of a roller cutter.

2. The rotary cutterhead according to claim 1, wherein said cut-ground-material passageways are radially elongate and extend through both the front and peripheral regions of said main frame forward section.

3. The rotary cutterhead according to claim 2, wherein said face-support-ring members are positioned on the cutterhead in at least the region of said main frame forward section in which said cut-ground-material passageways are located.

4. The rotary cutterhead according to claim 1, further stationary means for closing off the face of the main frame forward section in all regions thereof between and around each of said roller cutters and each of said cut-ground-material passageways.

5. The rotary cutterhead according to claim 4, wherein each of said face-support-ring members overlaps underlying portions of said cutterhead face closing means, said roller cutter mounting means and said cut-ground-material passageways.

6. The rotary cutterhead according to claim 1, wherein each of said face-support-ring members includes an forwardly directed face section and an integral, inwardly disposed shank section which is narrower than said face section, each of said shank sections having portions fixedly attached to underlying portions of said cutterhead main frame forward section.

7. The rotary cutterhead according to claim 5, wherein each of said face sections includes an outwardly projecting flange member and wherein each of said shank sections includes an integral web member, said web member being disposed perpendicularly to said flange member to cooperate with said flange member to form a T-shaped cross section, and said web member having an inwardly directed free edge portion fixedly attached to underlying portions of said cutterhead closing means and said roller cutter mounting means.

8. A rotary cutterhead according to claim 1, wherein adjacent face-support-ring members define an annular opening disposed forwardly of said main frame forward section, said annular opening being of substantially constant width about its entire circumference.

9. The rotary cutterhead according to claim 8, wherein adjacent annular openings progressively increase in width as the distance between said annular opening and the center of the cutterhead increases.

10. The rotary cutterhead according to claim 1 or 8, wherein each of said roller cutters includes an annular rim which is encircled by said peripheral cutting edge portions; and each of said roller cutters is positioned on the cutterhead so that substantially the full depth of its corresponding perpheral cutting edge portion projects forwardly of the envelope defined by the front faces of said face-support-ring members.

11. The rotary cutterhead according to claim 1, wherein each of said roller cutters includes a disc cutter, each of said disc cutters being progressively, radially outwardly spaced from a location closely adjacent the axis of rotation of the cutterhead to cut concentric kerfs upon rotation of the cutterhead.

12. The rotary cutterhead according to claim 1, further comprising wear beads on the front face of each of said face-support-ring members, said wear beads being formed from material which is substantially harder than the material from which said corresponding face-support-ring member is constructed to thereby protect said face-support-ring member from abrasion by the material being excavated.

13. The rotary cutterhead according to claim 1, wherein each of said cut-ground-material passageways is radially elongate and includes a front opening at the forward side of said cutterhead main frame forward section.

14. The rotary cutterhead according to claim 13, further comprising a plurality of scraper cutters positioned along portions of trailing edges of each of said cut-ground-material passageway front openings; and scraper cutter mounting plate means located at the trailing edge of each of said cut-ground-material passageway openings said scraper cutter mounting plate means extending outwardly from said passageway front openings to intersect the underside of said face-support-ring members, each of said scraper cutters being detachably attached to a corresponding scraper cutter mounting plate means to extend between side portions of, and forwardly of adjacent face-support-ring members.

15. The rotary cutterhead according to claim 14, wherein each of said scraper cutters projects rearwardly of the envelope defined by said peripheral cutting edge portions of said roller cutters.

16. The rotary cutterhead according to claim 1, further comprising a plurality of scoop walls located within the interior peripheral portions of the cutterhead, each of said scoop walls being disposed perpendicularly to the circumference of the cutterhead and radially about the axis of rotation of the cutterhead, each of said scoop walls having forwardly and radially outwardly directed edge portions which abut against rearwardly and radially inwardly directed portions, respectively, of said main frame forward section, and having rearwardly directed edge portions which abut against adjacent portions of said main frame rearward section.

17. The rotary cutterhead according to claim 1, wherein each of said face-support-ring members, at a location of interference with a roller cutter, is cut away a minimum amount needed to accommodate such interfering roller cutter.

18. The rotary cutter according to claim 17, wherein each of said face-support ring members includes an outwardly directed face section and an integral, inwardly disposed shank section which is narrower than said face section, each of said shank sections being fixedly attached to underlying portions of said cutterhead main frame forward section.

19. A rotary cutterhead for an earth boring machine, comprising:

a main frame having a rearward section by which the cutterhead is mounted onto an earth boring machine for rotation about an axis of rotation, and an integral forward section disposed forwardly of said rearward section;

a plurality of roller cutters, and cutter mounting means for mounting said roller cutters within said main frame forward section, each of said roller cutters having peripheral cutting edge portions projecting forwardly of said main frame forward section to cut concentric kerfs upon rotation of the cutterhead; and a plurality of radially spaced apart face-support-ring members mounted on the cutterhead to overlie said main frame forward section, each of said face-support-ring members being disposed slightly rearwardly of said roller cutter peripheral edges and being circumferentially continuous except where continuation of a face-support-ring member would overlie the peripheral cutting edge portion of a roller cutter.

20. The rotary cutterhead according to claim 19, wherein each of said face-support-ring members at a location of interference with a peripheral cutting edge portion of a roller cutter is cut away the minimum amount needed to accommodate such roller cutter.

21. The rotary cutterhead according to claim 20, wherein each of said face-support-ring members includes a forwardly directed face section and an integral, rearwardly disposed shank section which is narrower than said face section, each of said shank sections having portions fixedly attached to underlying portions of said cutterhead main frame forward section.

22. A rotary cutterhead according to claim 19, wherein adjacent face-support-ring members define an annular opening disposed forwardly of said main frame forward section, said annular opening being of substantially constant width about its entire circumference.

23. The rotary cutterhead according to claim 22, wherein said annular openings progressively increase in width as the distance between said annular openings and the center of the cutterhead increases.

24. The rotary cutterhead according to claim 19, further comprising wear beads on the front face of each of said face-support-ring members, said wear beads being formed from the material which is substantially harder than the material from which said corresponding base-support-ring member is constructed to thereby protect said face-support-ring member from abrasion by the material being excavated.

25. The rotary cutterhead according to claim 19, further comprising:

a plurality of radially elongate cut-ground-material passageways formed in said main frame forward section at locations between said roller cutters, said cut-ground-material passageways extending through both the front and peripheral regions of said main frame; and stationary means for closing off the face of the said main frame forward section in all regions thereof between and around each of said roller cutters and each of said cut-ground-material passageways.

26. The rotary cutterhead according to claim 25, wherein said face-support-ring members are positioned on the cutterhead in at least the regions of the main frame forward section in which said cut-ground-material passageways are located.

27. The rotary cutterhead according to claims 25, or 26:

wherein each of said cut-ground material passageways includes a front opening at the forward side of said cutterhead main forward section; and further comprising a plurality of scraper cutters positioned along portions of trailing edges of each of said cut-ground material passageway front openings, and mounting plate means located at the trailing edge of each of said cut-ground-material passageway openings, said scraper cutter mounting plate means extending outwardly from said cutterhead opening to intersect the underside of said face-support-ring members, each of said scraper cutters being detachably attached to a scraper mounting plate means to extend between side portions of, and forwardly of, adjacent face-support-ring members.

28. The rotary cutterhead according to claim 19, further comprising a plurality of scoop walls located within the interior peripheral regions of the cutterhead, each of said scoop walls being disposed perpendicularly to the circumference of the cutterhead and radially about the axis of rotation of the cutterhead, each of said scoop walls having forward and radially outwardly directed edge portions which abut against rearwardly and radially inwardly directed portions, respectively, of said main frame forward section, and having rearwardly directed edge portions which abut against forwardly directed, adjacent portions of said main frame rearward section.

* * * * *